US005577965A

United States Patent [19]

Burgess

[11] Patent Number: 5,577,965

[45] Date of Patent: Nov. 26, 1996

[54] GOLF CLUB

[76] Inventor: Dennis A. Burgess, 7205 E. Stone Canyon Dr., Tucson, Ariz. 85715

[21] Appl. No.: 600,292

[22] Filed: Feb. 12, 1996

[51] Int. Cl.[6] ..... A63B 69/36

[52] U.S. Cl. ..... 473/230; 473/330; 473/340

[58] Field of Search ..... 473/226, 230, 473/231, 324, 325, 330, 340

[56] References Cited

U.S. PATENT DOCUMENTS

| | | |
|---|---|---|
| D. 193,399 | 8/1962 | McGranaghan . |
| 2,300,043 | 8/1941 | Carney . |
| 2,426,274 | 8/1947 | Kramer . |
| 3,044,781 | 7/1962 | Murphy . |
| 4,688,799 | 8/1987 | Johnson . |
| 5,172,915 | 12/1992 | Flis . |
| 5,207,721 | 5/1993 | Lobdel . |
| 5,362,056 | 11/1994 | Minotti . |

FOREIGN PATENT DOCUMENTS 8897 of 1905 United Kingdom .

*Primary Examiner*—Sebastiano Passaniti
*Attorney, Agent, or Firm*—James V. Harmon

[57] ABSTRACT

A golf club has a clubhead upon which is rotatably mounted a rotary member or roller. The roller is exposed at the front of the club to engage the golf ball and is free to rotate upon a horizontal axis while in contact with the golf ball to facilitate rotation of the golf ball as the club moves the golf ball across the ground. The clubhead preferably has a front face that is directed toward the ball and the roller is mounted on the clubhead as a part of the front face of the club so as to engage the ball and to rotate freely while in contact with the ball. Typically, the clubhead has a pair of horizontally spaced apart supporting walls with an opening between them to accommodate the roller and to support the roller for rotation about a horizontal axis with the roller located at an elevation adapted to engage the center of the ball but to be held out of contact with the ground.

16 Claims, 1 Drawing Sheet

GOLF CLUB

FIELD OF THE INVENTION

This invention relates to sporting equipment and more particularly to an improved golf club.

BACKGROUND OF THE INVENTION

The present invention is directed to an improved golf club and particularly toward achieving greater accuracy in putting. In nearly 400 years, there has been virtually no improvement in the way a golf ball is engaged by the club in putting the ball toward the hole. When an ordinary putter begins to move the ball, especially on a short putt, the contact between the ball and the putter causes the ball to skid as it travels across the ground. I have found that frictional contact between the ball and the putter blade has a tendency to cause the ball to move erratically, i.e., to jump, skip or hop during the first portion of the stroke. There are actually three phenomena that are involved in the problem of achieving putting accuracy. On somewhat longer shots in which the ball is struck harder, the impact causes the ball to fly forward initially without rotating and then to skid across the ground, resulting in erratic movement. Finally, during the last portion of the stroke as the ball starts rotating, the angular momentum of the ball becomes important in maintaining rectilinear movement of the ball along a straight line toward the cup. However, in an ordinary putter, friction between the ball and the face of the putter leads to the skidding action already described, contributing to erratic movement of the ball, e.g., jumping or skipping which I have found tends to lessen the accuracy of the shot.

In view of these and other deficiencies of the prior art, it is a primary object of the present invention to provide an improved golf club that will enable shots, especially putting shots, to be accomplished more accurately by preventing the ball from skidding against the face of the club or across the ground.

Another object of the invention is to find a way to assist the ball in beginning to rotate more quickly owing to the friction between itself and the ground to thereby more quickly develop enough angular momentum to help the ball move more accurately on a straight line toward the cup.

An additional object is to provide an improved golf club especially well suited as a putter which is rugged in construction, economical to produce, and yet reliable in its ability to allow the ball to roll freely while in contact with the club.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a golf club with a clubhead upon which a rotary ball-engaging member is supported for rotation. The rotary member has a movable surface that contacts the ball. The movable surface of the rotary member is exposed at the front of the club where it can strike the golf ball and is free to rotate upon a horizontal axis while in contact with the golf ball to facilitate rotation of the ball as the club moves the ball across the ground.

The rotational member is typically a roller mounted for rotation on a horizontal axis and located on the clubhead in a position for engaging the side of the ball when the ball is struck.

In its preferred form, the clubhead has a front face that is directed toward the ball with the rotary member, e.g., a roller mounted on the clubhead as a part of the front face of the club so as to be exposed where it can contact the ball and is free to rotate while in contact with the ball.

Typically, the clubhead has a pair of horizontally spaced apart supporting walls with an opening between them to accommodate the roller and bearings to support the roller for rotation about a horizontal axis extending between the supporting walls with the roller located at an elevation where it will strike the side of the ball but out of contact with the ground to thereby prevent frictional engagement with the ground so that the roller is free to rotate in a direction opposite that which would be imparted to the roller if it were to contact the ground.

THE FIGURES

DETAILED DESCRIPTION OF THE INVENTION

Figure 1:
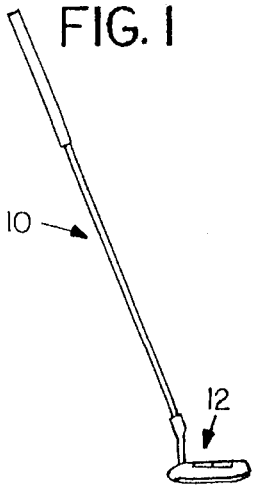
FIG. 1 is a rear elevational view of a golf club embodying the present invention.
Figure 4:
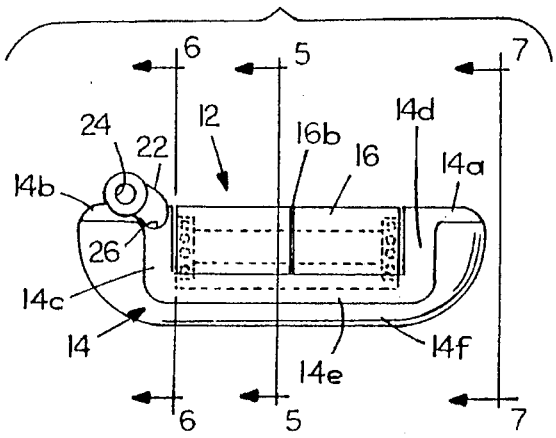
FIG. 4 is a top view of the clubhead.
Figure 5:
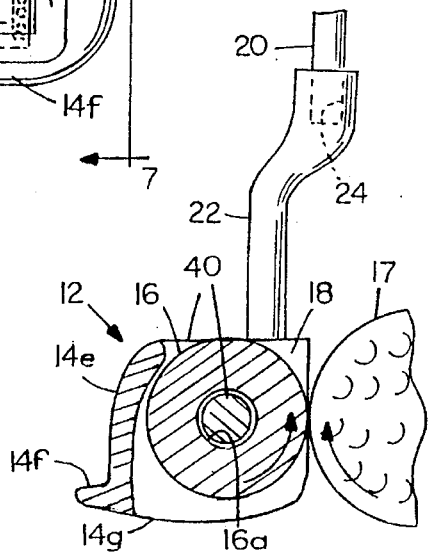
FIG. 5 is a vertical cross-sectional view taken on line 5—5 of FIG. 4.
Figure 2:
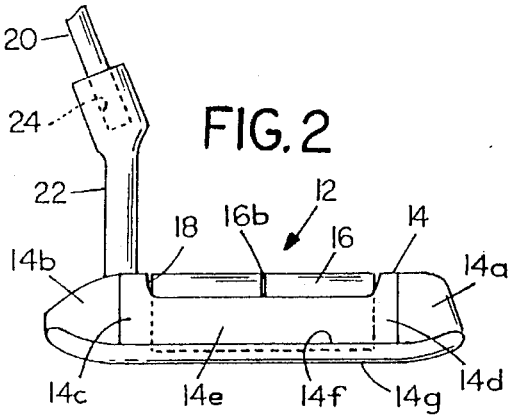
FIG. 2 is a rear view of the clubhead on a larger scale than in FIG. 1.

The improved golf club 10 according to the present invention has a clubhead 12 which comprises a clubhead body or housing 14 including a pair of generally upright aligned and horizontally spaced apart face members **14*a*, 14*b* which form the front and rear portions of the face of the club 10 and integrally connected upright horizontally spaced apart parallel supporting walls 14*c*, 14*d* with an upright rear wall 14*e* between them and an integral bottom wall 14*f* which projects rearwardly a short distance from the front face members 14*a*, 14*b* and the rear wall 14*e*. As shown in FIG. 5, the clubhead 12 also includes a bottom surface 14*g*** which is preferably not flat but instead is arcuate as shown such that its front and rear edges are slightly elevated to reduce unintended ground contact during a stroke.

Between the upright walls **14*c*–14*e* is an opening or recess 18 which is open at the front, top and bottom for receiving a rotary member in the form of a cylinder or roller 16 having a rotatable outer surface positioned at the proper height on the clubhead 12 for engaging a golf ball 17 (FIG. 5) when a stroke is made. As can be best seen in FIG. 5, the surface of the roller 16 is tangent to the front wall or face members 14*a*, 14*b* of the club 10 so that as each stroke is made, the roller 16 will engage the ball 17 (FIG. 5). The roller 16 is typically about one inch in diameter and is held within the clubhead 12 so that its lower edge is about one-eighth inch above the bottom surface 14*g* of the clubhead 12 to prevent the roller 16** from touching the ground.

The club 10 includes a standard club shaft 20 having an angled lower extension or neck 22 provided with a socket 24 at its upper end for receiving the club shaft 20. The neck 22 is recessed within a socket 26 in the top of the clubhead 12. Rigid connections are established within the sockets 24 and 26, e.g., with a press fit or adhesive.

Figure 6:
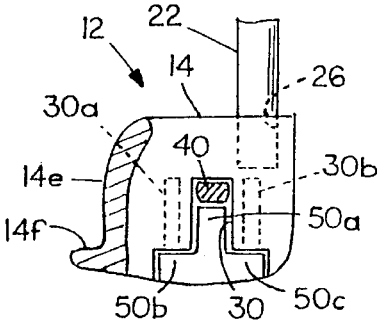
FIG. 6 is a cross-sectional view taken on line 6—6 of FIG. 4.
Figure 3:
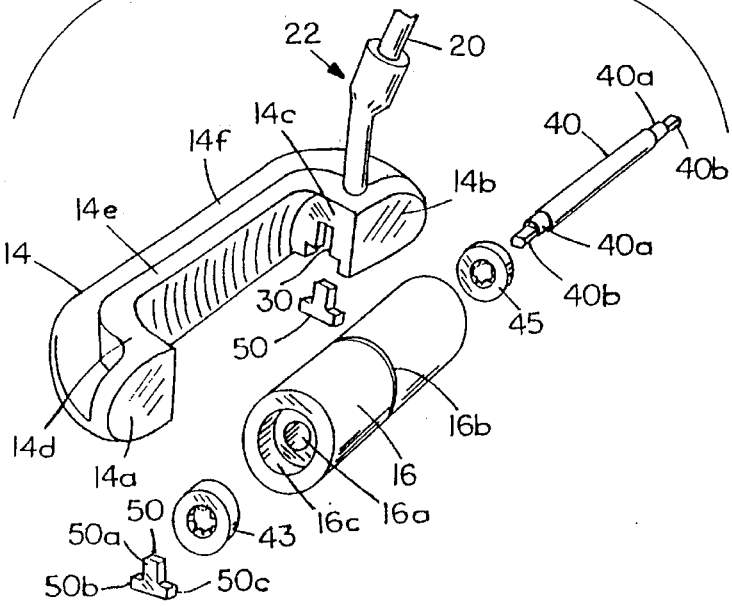
FIG. 3 is a front perspective exploded view of the clubhead.
Figure 7:
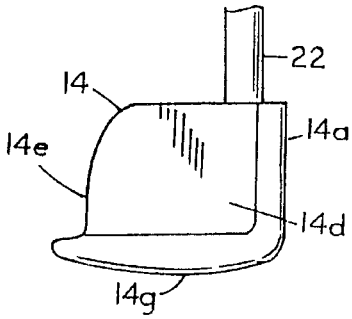
FIG. 7 is an end elevational view taken on line 7—7 of FIG. 4.

The roller 16 is provided with a central bore 16*a*, the bore diameter allowing clearance for receiving a roller-supporting shaft 40 and is provided at each end with a bored socket 16*c* (only one of which is shown in FIG. 3) for receiving a ball bearing 43 and 45 (FIG. 3). At the center of the roller 16 is a circumferentially extending circular marking or groove 16*b* to aid the user in aiming the shot. The inner race of each ball bearing 43, 45 is press-fitted onto portions 40*a* at each end of the shaft 40, and each outer race is press-fitted into one of the sockets 16*c* of the roller 16. The shaft 40 is provided at each end with diametrically opposed flat surfaces as shown in FIG. 5 which are firmly held in two similar T-shaped recesses 30 in the walls 14*c* and 14*d* (only one of which is shown in FIGS. 3 and 6) by means of T-shaped keepers 50 that fit into the recesses 30 and include lateral flanges 50*b*, 50*c* bored for receiving fasteners such as screws which are screwed into threaded sockets 30*a*, 30*b* in walls 14*c* and 14*d*, one of which is shown in FIG. 6. Consequently, the shaft 40 is fixed while the roller 16 is free to rotate on a horizontal axis about its own center in a counterclockwise direction as seen in FIG. 5 while in contact with the ball 17 which, because of its engagement with the ground, rotates freely in a clockwise direction as seen in the figure. In this way the rotation of the roller 16 facilitates rotation of the ball 17 as the ball is moved across the ground and prevents the ball 17 from hopping, skipping or jumping. In addition, the freedom of the ball 17 to rotate, quickly establishes an angular momentum in the ball which helps the ball move in a straight line across the ground toward the cup.

The clubhead can be made from metal, e.g., brass, aluminum or steel.

The invention thus makes it possible to achieve more accurate putting in three ways. First, it reduces or eliminates frictional engagement between the ball and the forward face of the putter, i.e., it prevents the ball from skidding across the front face of the clubhead. Second, it enables the ball to roll more freely while in contact with the ground. Third, free rotation of the ball enables the ball to more quickly develop rotational momentum which in turn helps the ball to move toward the cup along a straight line, thereby enhancing putting accuracy. In addition, the invention makes possible point contact between the clubhead and the ball to further contribute to more accurate putting.

Many variations of the present invention within the scope of the appended claims will be apparent to those skilled in the art once the principles described herein are understood.

What is claimed is:

1. A golf club comprising, a clubhead, a rotary member supported on the clubhead and including a movable surface, said rotary member is mounted with the movable surface thereof exposed at a front portion of said club to engage a golf ball, said rotary member is free to rotate upon an axis at the center of the rotary member while in contact with the ball to facilitate rotation of the ball as the club moves the ball across the ground, the clubhead has a lower portion that extends below the rotary member to hold the rotary member out of contact with the ground when the ball is struck, the lower portion of the clubhead is positioned to prevent the ground from causing the rotary member to rotate during use so that the ball and rotary member are able to roll freely in opposite directions as the ball is moved across the ground by the rotary member even if the clubhead strikes the ground, and rotation of the rotary member reduces frictional engagement between the roller and the ball.

2. The golf club of claim 1 wherein the rotary member is a roller mounted for rotation upon the clubhead upon a horizontal axis.

3. The golf club of claim 1 wherein the rotary member is mounted for rotation upon a shaft and a ball bearing is secured between the shaft and the rotary member.

4. A golf club comprising, a club shaft, a clubhead, a roller mounted for rotation on a horizontal axis upon the clubhead in a position for engaging a golf ball when the ball is struck, the roller is free to rotate upon said horizontal axis while in contact with the ball whereby rotation of the roller when in contact with the ball facilitates rotation of the ball as the ball moves across the grounds, the clubhead has a lower portion that extends below the roller to hold the roller out of contact with the ground when the ball is struck, the lower portion of the clubhead is positioned to prevent the ground from causing the roller to rotate during use so that the ball and roller are able to roll freely in opposite directions as the ball is moved across the ground by the roller even if the clubhead strikes the ground, and rotation of the roller reduces frictional engagement between the roller and the ball.

5. The golf club of claim 4 wherein the roller includes a central axially extending bore, a roller-supporting shaft is mounted within the bore and connected to the clubhead, and bearing means is operatively engaged between the shaft and the roller.

6. The golf club of claim 5 wherein the bearing means comprises a bearing at each end of the roller and each bearing including an outer race press-fitted to the roller and an inner race press-fitted onto the supporting shaft.

7. A golf club comprising, a club shaft, a clubhead, a roller mounted for rotation on a horizontal axis upon the clubhead in a position for engaging a golf ball when the ball is struck, the roller is free to rotate upon said horizontal axis while in contact with the ball whereby rotation of the roller when in contact with the ball facilitates rotation of the ball as the ball moves across the ground, and the clubhead includes a pair of longitudinally spaced apart upright supporting walls with an opening therebetween and the roller is mounted for rotation upon an axis extending horizontally between the upright walls.

8. A golf club comprising, a club shaft, a clubhead, a roller mounted for rotation on a horizontal axis upon the clubhead in a position for engaging a golf ball when the ball is shuck, the roller is free to rotate upon said horizontal axis while in contact with the ball whereby rotation of the roller when in contact with the ball facilitates rotation of the ball as the ball moves across the ground, the roller includes a central axially extending bore, a roller-supporting shaft is mounted within the bore and connected to the clubhead, and bearing means is operatively engaged between the shaft and the roller, and the shaft includes end portions and the end portion at each end of the shaft is connected to the clubhead by a keeper member that is affixed to the clubhead.

9. A golf club comprising, a golf club shaft, a clubhead connected to the golf club shaft, said clubhead having a pair of horizontally spaced supporting walls with an opening therebetween, a golf ball-impacting roller mounted in the opening for rotation upon a horizontal axis and held by the supporting walls at an elevation such that a cylindrical surface of said roller engages the ball when the ball is struck, the supporting walls hold the roller out of contact with the ground, whereby the rotational support of the roller will reduce frictional engagement between the roller and ball so that the club will help the ball to roll freely as the ball moves across the ground toward a golf cup.

10. The golf club of claim 9 wherein the head of the club includes a housing including a pair of longitudinally spaced apart generally upright front face members integral with said supporting walls, a rear wall connected between rear ends of said supporting walls, and a horizontal bottom wall extending rearwardly from the front face members and the rear wall.

11. The golf club of claim 10 wherein the clubhead framework includes a recess between the supporting walls to receive the roller, the recess is open at the front as well as at the top and bottom thereof, and the roller includes an outer cylindrical surface that is substantially aligned between a forward face of each of said front face members.

12. The golf club of claim 9 wherein the roller includes a circumferentially extending central marking to aid in aiming the club.

13. The golf club of claim 9 wherein the roller is mounted for rotation upon a friction reducing bearing at each end thereof.

14. A golf club comprising, a golf club shaft, a clubhead connected to the golf club shaft, a golf ball-impacting roller mounted on the clubhead for rotation upon a horizontal axis and held by the clubhead at an elevation such that a cylindrical surface of said roller engages a golf ball when the ball is struck, the clubhead has a lower portion that extends below the roller to hold the roller out of contact with the ground when the ball is struck whereby the rotational support of the roller reduces frictional engagement between the roller and the ball, and the lower portion of the clubhead prevents the ground from rotating the roller during use so that the ball and roller are able to roll freely in opposite directions as the ball is moved across the ground by the roller.

15. The golf club of claim 14 wherein the clubhead has a forwardly opening recess with supporting walls at each end thereof, and the roller is supported for rotation between the supporting walls within said lower portion of the clubhead at an elevation that is below the roller and laterally thereof.

16. The clubhead of claim 14 wherein said lower portion comprises a bottom wall as a part of the clubhead and the bottom wall has a bottom surface located below the roller to keep the roller elevated above the ground.

* * * * *

UNITED STATES PATENT AND TRADEMARK OFFICE

CERTIFICATE OF CORRECTION

PATENT NO. : 5,577,965

DATED : Nov.26, 1996

INVENTOR(S) : Dennis A. Burgess

It is certified that error appears in the above-indentified patent and that said Letters Patent is hereby corrected as shown below:

Col. 4, line 8 (claim 1), change "roller" to ---rotary member---.

Col. 6, line 31 (claim 15), change "within" to ---with---.

Signed and Sealed this

Twenty-second Day of April, 1997

Bruce Lehman

*Attest:*

BRUCE LEHMAN

*Commissioner of Patents and Trademarks*

*Attesting Officer*